US007091916B2

(12) United States Patent
Paratte

(10) Patent No.: US 7,091,916 B2
(45) Date of Patent: Aug. 15, 2006

(54) PORTABLE ELECTRONIC DEVICE, IN PARTICULAR A TIMEPIECE, COMPRISING AN ANTENNA FORMED BY A LARGE-DIAMETER COIL

(75) Inventor: Daniel Paratte, Neuchâtel (CH)

(73) Assignee: ETA SA Manufacture Horlogére Suisse, Grenchen (CH)

( * ) Notice: Subject to any disclaimer, the term of this patent is extended or adjusted under 35 U.S.C. 154(b) by 186 days.

(21) Appl. No.: 10/735,825

(22) Filed: Dec. 16, 2003

(65) Prior Publication Data

US 2004/0179433 A1 Sep. 16, 2004

(30) Foreign Application Priority Data

Dec. 16, 2002 (EP) ..... 02080691

(51) Int. Cl.
*H01Q 1/12* (2006.01)

(52) U.S. Cl. ..... 343/718; 368/10; 368/88

(58) Field of Classification Search ..... 368/10, 368/88; 343/718
See application file for complete search history.

(56) References Cited

U.S. PATENT DOCUMENTS

| | | | | |
|---|---|---|---|---|
| 4,977,614 | A * | 12/1990 | Kurcbart | 455/193.1 |
| 5,144,325 | A * | 9/1992 | Kurcbart | 343/718 |
| 5,768,217 | A | 6/1998 | Sonoda et al. | |
| 6,134,188 | A * | 10/2000 | Ganter et al. | 368/47 |
| 6,278,873 | B1 * | 8/2001 | Itakura et al. | 455/351 |
| 6,853,605 | B1 * | 2/2005 | Fujisawa et al. | 368/10 |
| 2002/0071346 | A1 * | 6/2002 | Paratte et al. | 368/10 |

FOREIGN PATENT DOCUMENTS

| | | |
|---|---|---|
| JP | 07059141 | 3/1995 |
| JP | 2000-056045 | 2/2000 |

OTHER PUBLICATIONS

European Search Report, completed Oct. 31, 2003.

* cited by examiner

*Primary Examiner*—Tho Phan
(74) *Attorney, Agent, or Firm*—Griffin & Szipl, P.C.

(57) ABSTRACT

The portable electronic device comprises a movement which is formed by a printed circuit board on the upper surface of which a digital display cell is disposed. At the side of the upper surface of the display cell, an antenna coil is disposed which covers the peripheral part of the cell. The electrical connection between the antenna coil and the printed circuit is produced by means of a connector which is formed by two corresponding male connectors and two female connectors. The male connectors are formed by elastically deformable blades which penetrate into two metallized holes of the board which define the two female connectors.

6 Claims, 5 Drawing Sheets

PORTABLE ELECTRONIC DEVICE, IN PARTICULAR A TIMEPIECE, COMPRISING AN ANTENNA FORMED BY A LARGE-DIAMETER COIL

FIELD OF THE INVENTION

This application claims priority from European Patent Application No. 02080691.5, filed Dec. 16, 2002, the entire disclosure of which is incorporated herein by reference.

The present invention relates to a portable electronic device, in particular a timepiece, equipped with a communication antenna formed by a coil with a large diameter relative to the dimensions of the housing of this electronic device.

BACKGROUND OF THE INVENTION

In order to limit the influence of the various electrical elements of a timepiece and likewise of the ferromagnetic materials forming the latter, the communication antenna is preferably placed in the upper region of the housing, i.e. at the side of the display means and/or of the glass covering these display means.

Furthermore, in order to ensure good reception and to permit communication at some distance from the timepiece, the coil of the antenna is formed by several turns with a diameter of the order of magnitude of the timepiece housing.

It is known from the prior art to integrate such a coil in a recess of the body or preferably in an opening of the housing, this opening surrounding by definition the upper glass of the housing. This latter solution permits the display means to be disengaged from the timepiece and in particular the use of a digital display which forms the major part or the whole of the screen of this timepiece.

In the conventional manner, a digital display is formed by an LCD cell. In the case of the present invention, the dimensions of this LCD cell are provided with the order of magnitude of the opening defined by the housing for the display means. However, the solution of integrating the antenna coil into an opening poses a double problem. Firstly, this necessitates having an opening forming at least partially a different element of the body in order to permit the introduction of the coil into this opening in a simple manner. Such an arrangement thus hardly permits a body-opening to be produced in one piece. As a result, the cost of the housing is increased, the assembly of this housing being more difficult and requiring some care due to the integration of the antenna coil into the opening. Next, such an arrangement restricts the production of the upper part of the housing. In fact, the dimensions of the housing in its upper part can be reduced only with difficulty because of the opening in the interior of which an antenna coil is disposed.

One object of the present invention is to alleviate the aforementioned disadvantages of the prior art.

Another object of the invention is to make available a watch equipped with a communication antenna which ensures very good reception and/or emission of electromagnetic signals and has a digital display with large dimensions.

More particularly, the object of the invention is to make available an electronic device which can be worn on the wrist with a digital display and an antenna coil with high efficiency which may be easily assembled on the portable device whilst restricting the spatial requirement.

SUMMARY OF THE INVENTION

For this purpose, the present invention relates to a portable electronic device, in particular a timepiece, comprising an electronic movement which is formed by a printed circuit board electrically connecting at least one electronic circuit, a digital display cell and a communication antenna formed by a coil having at least one turn, this coil having two ends for electrical connections, characterised in that said display cell extends above said board, and in that said coil is disposed at the side of the upper surface of this display cell. The two ends of the antenna are electrically connected to said board by means of two connection means which form two corresponding male connectors and two female connectors.

According to a preferred embodiment, the two connection means are formed respectively by two elastically deformable blades.

According to one particular embodiment of the invention, the two connection means are mounted on a support which is disposed below the coil and has two regions for electrical contact for the two ends of the coil. The two female connectors are formed by two metallised holes which are provided in said printed circuit board.

BRIEF DESCRIPTION OF THE DRAWINGS

The present invention will be described subsequently in more detail with reference to the attached drawing, given by way of example, but in no way limited thereto, in which.

DETAILED DESCRIPTION OF THE ILLUSTRATIVE EMBODIMENTS

A preferred embodiment of the present invention will subsequently be described with reference to FIGS. 1 to 5.

Figure 5:
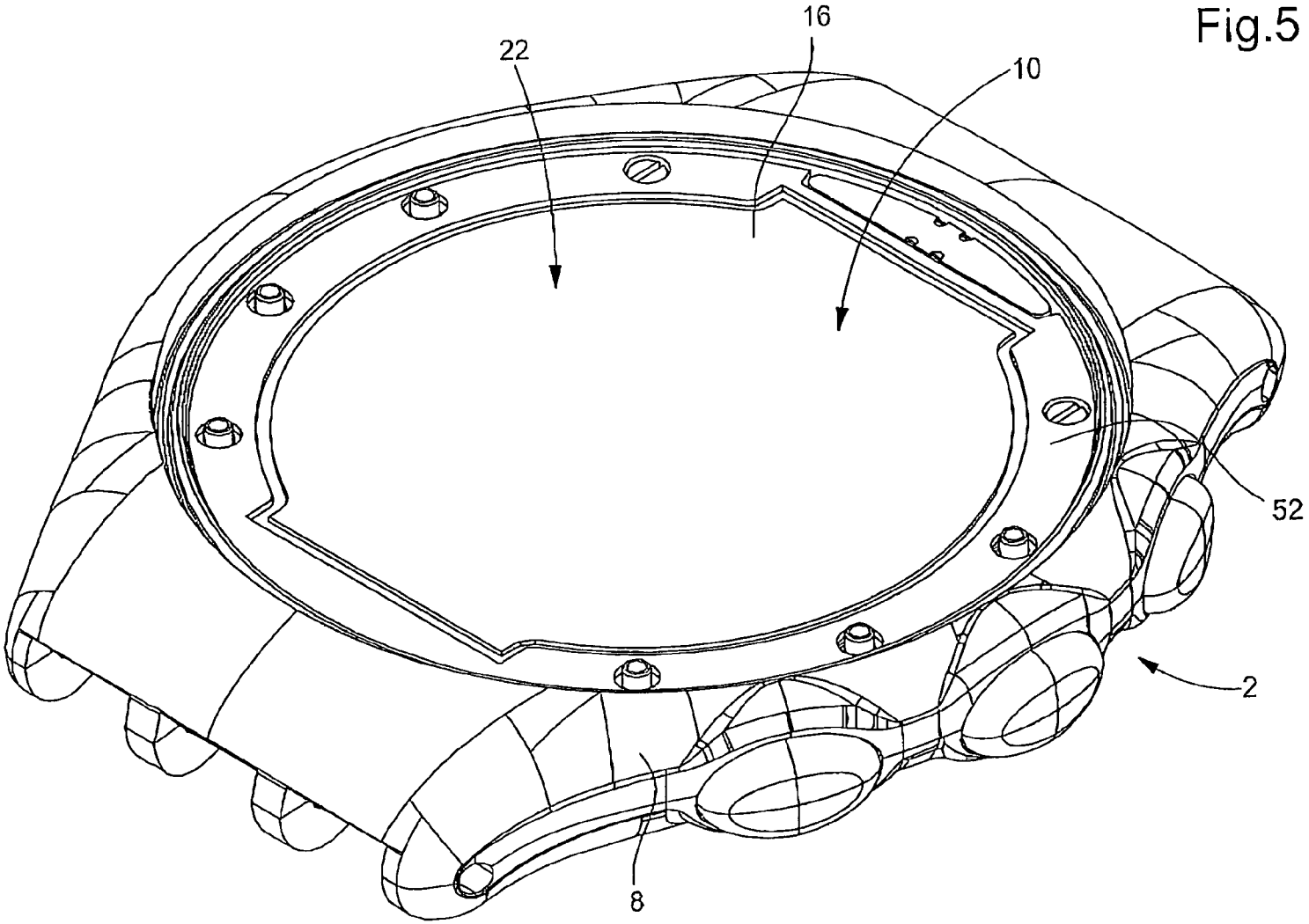
FIG. 5 is a view from above in perspective of a timepiece equipped with an electronic movement with a digital display such as that represented in FIG. 3, but without the antenna coil.

The portable electronic device, in this instance the timepiece 2, represented partially in FIG. 5, comprises a printed circuit board 4 which forms a main support for the electronic movement 6 equipping the watch bracelet 2. It will be noted subsequently that the electronic movement 6 forms a compact and unitary module which can be integrated into various portable electronic devices which include a communication antenna capable of emitting and/or of receiving electromagnetic signals. The housing 8 is provided only by way of example. This example illustrates one of the advantages of the invention, i.e. that it is readily possible to dispose the electronic movement 6, which comprises the communication antenna and its electronic circuit, in a clock housing having a body-opening formed by one and the same part with a compact design.

The movement 6 comprises furthermore an LCD display cell 10 comprising two substrates 12 and 14 and a polariser film 16 which defines its upper surface. The cell 10 covers the major part of the PCB board 4 and has a relatively large display surface. In fact, as likewise emerges from FIG. 5, the dimensions of the display zone of the cell 10 substantially defined by the film 16 are of the same order of magnitude as the dimensions of the housing 8 in the plane defined by this film 16.

According to the invention, an antenna coil 20 is disposed at the side of the upper surface 22 of the cell 10. More precisely, the coil 20 is disposed on the LCD cell 10 and covers the peripheral region of the film 16.

According to the invention, a support 24 of relatively small dimensions is disposed under the coil 20 peripherally to the latter. The support 24 has two regions for electrical contacts 26 and 28 at the side opposed to the coil 20. The coil 20 is formed by a plurality of turns (not represented) and has two ends 30 and 31 respectively welded to the two regions 26 and 28.

Figure 1:
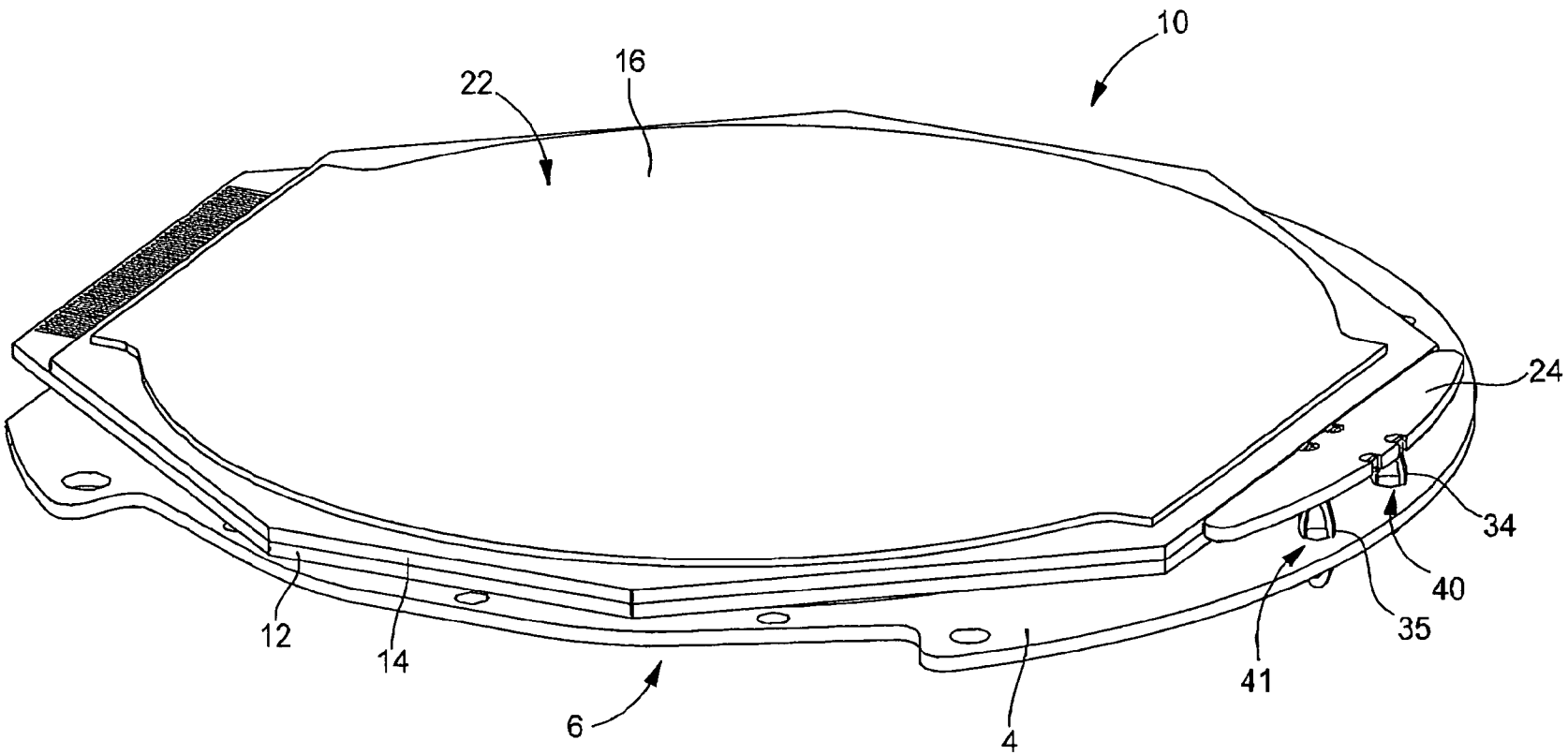
FIG. 1 is a partial view of a first embodiment of a portable electronic device according to the invention.
Figure 2:
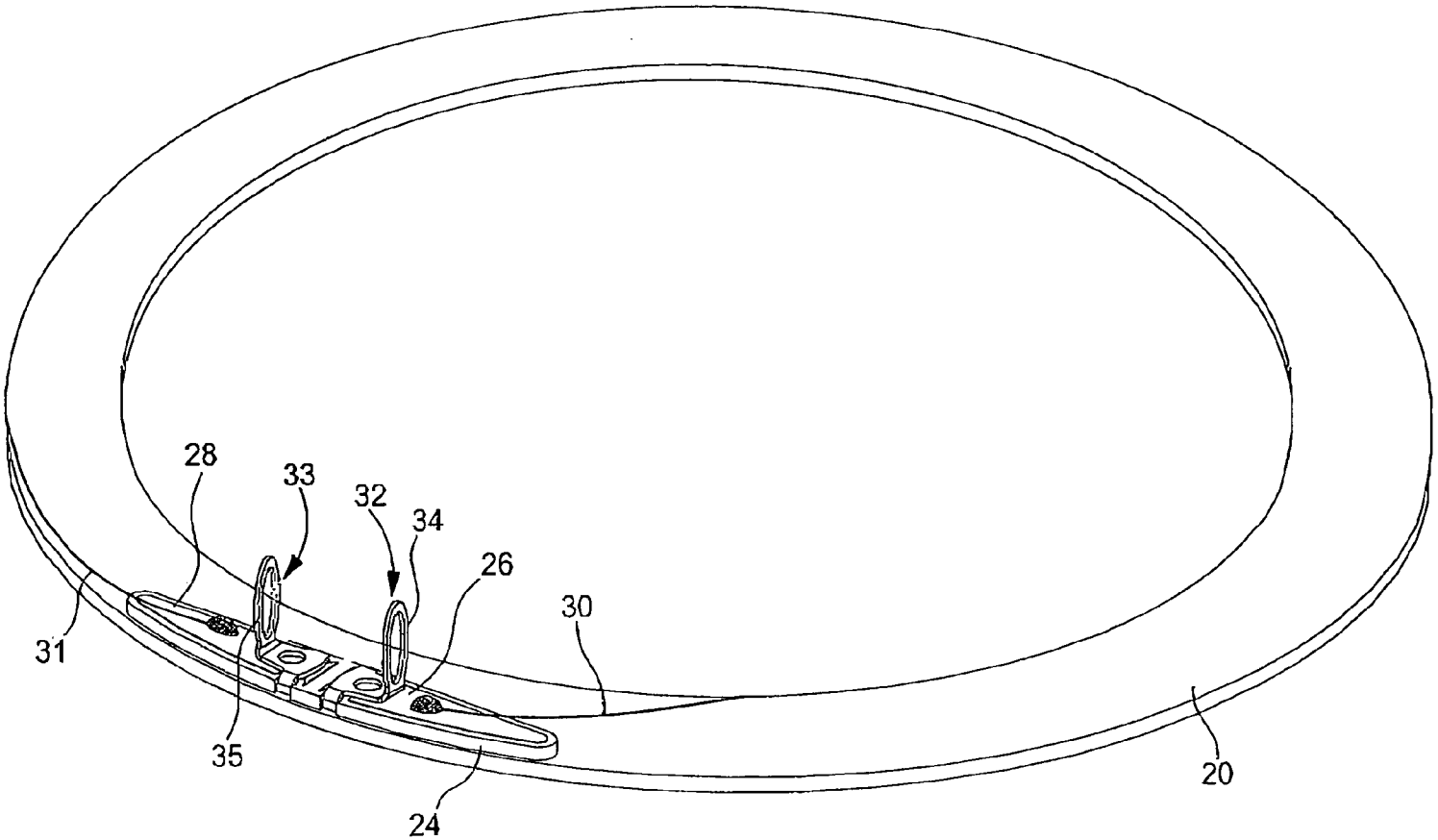
FIG. 2 is a schematic view of an antenna coil associated with two electrical connection means according to the invention.
Figure 3:
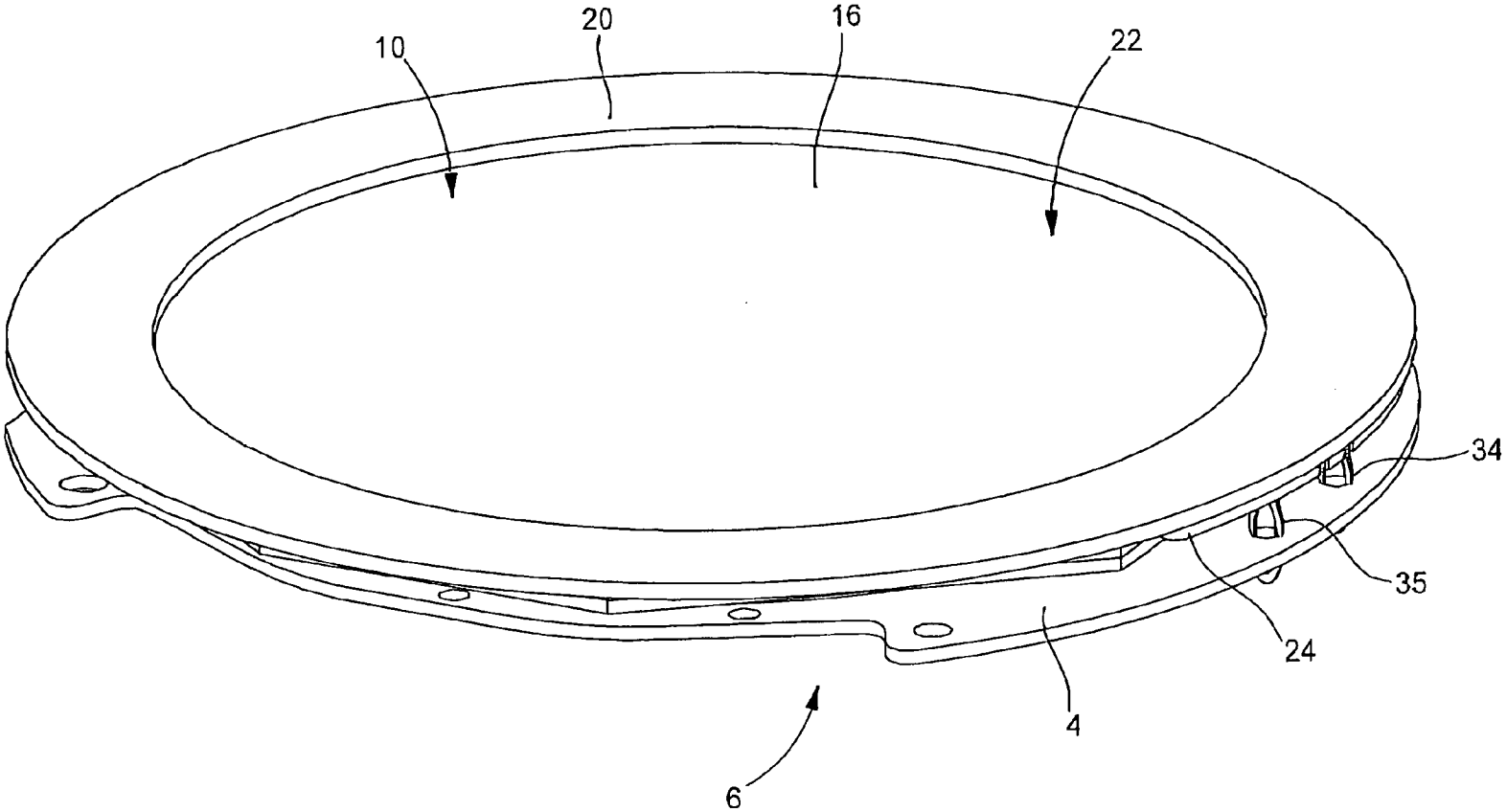
FIG. 3 is a perspective view of the device of FIG. 1 completed by the antenna coil of FIG. 2.

Two means 32 and 33 for electrical connection to the board 4 are disposed on the support 24 so as to be electrically connected respectively to the two regions 26 and 28. The two means 32 and 33 define two male connectors. According to a particular feature of the invention, the two means 32 and 33 each have an elastically deformable blade 34, 35 having an ellipsoidal form. These two blades extend upwards from the substrate 24, perpendicularly to the latter. In FIG. 1, there are represented the substrate 24 and the two blades 34 and 35 after assembly of the module illustrated in FIG. 2 on the module formed by the board 4 and the cell 10. FIG. 3 differs from FIG. 1 only by the illustration of the coil 20 which is disposed at the side of the upper surface of the cell 10.

The two connection means 32 and 33 extend into the peripheral region of the display cell 10, in a perpendicular manner to the upper surface 22 of this cell. The two blades 34 and 35 which form the connection means pass through two metallised holes 40 and 41 provided in the board 4. These holes 40 and 41 define two female connectors. The blades 34 and 35 exert a radial pressure on the lateral surface of the holes 40 and 41 so as to ensure a good electrical connection between the antenna coil 20 and the electronic circuit 44 of the communication unit which is disposed in the portable device according to the invention. This unit 44 is electrically connected to the metallised walls of the holes 40 and 41 by two conductive tracks 46 and 47.

Figure 4:
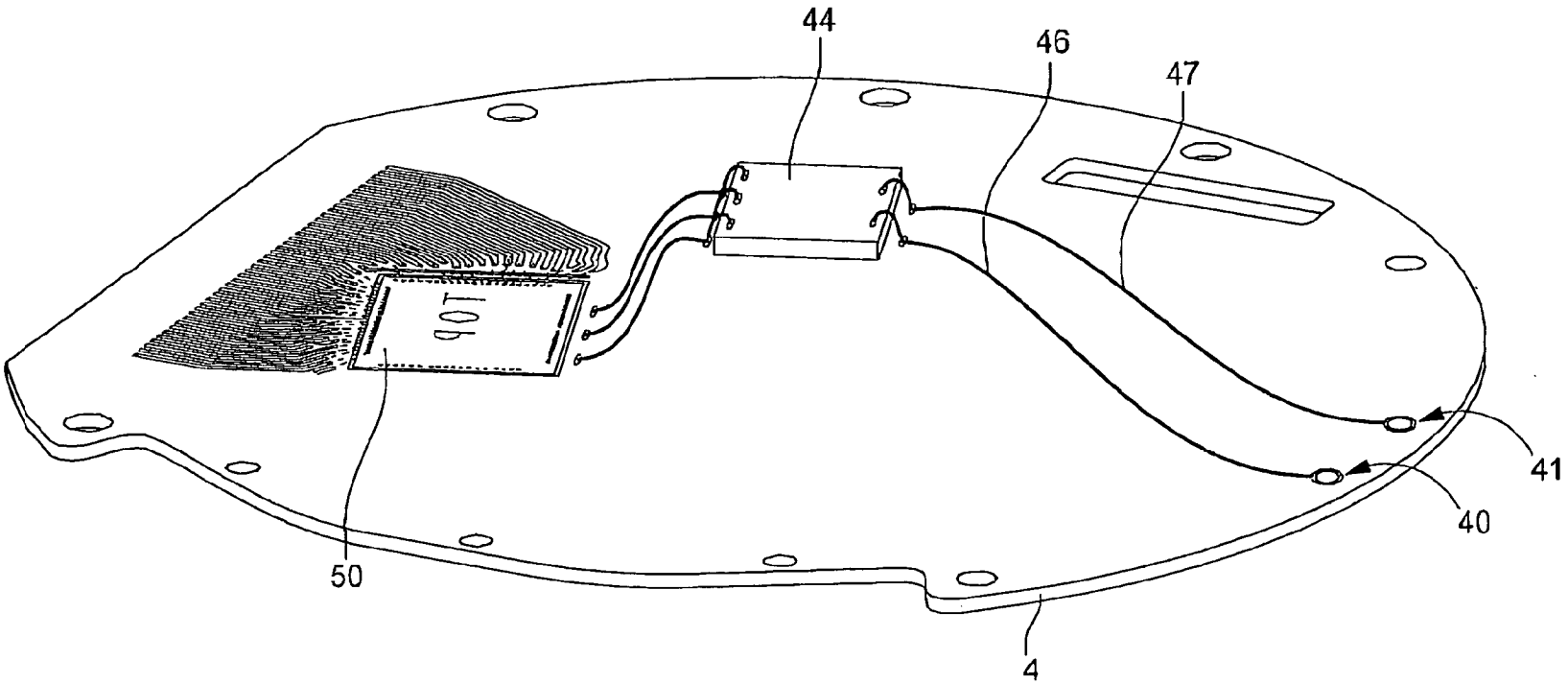
FIG. 4 is a schematic view of the lower surface of a main printed circuit board of the first embodiment.

According to the variant illustrated in FIG. 4, an electronic circuit 50 separate from the electronic unit 44 is provided in order to control the digital display of the cell 10.

The assembly of the electronic movement 6 is simple. The printed circuit board 4 forms a base upon which the cell 10 is disposed. The latter is electrically connected to the lower face of the board 4 by a flexible connector. The module illustrated in FIG. 2, which comprises the coil 20 and the two connection means 32 and 33 is simply assembled on the movement 6. It suffices to place the blades 34 and 35 opposite the holes 40 and 41 and to exert some pressure upon the coil at the support point 24. The electrical connection between the coil and the printed circuit board 4 is thus effected without difficulty, according to the principle of an electrical socket, without requiring welding or another means of subsequent electrical connection. Furthermore, the antenna module of FIG. 2 can easily be dismantled if necessary. The antenna 20 which is situated in the upper region of the timepiece, i.e. at the side of the glass which covers the digital display, is thus connected in a rapid and effective manner to the board 4 which carries the electronic circuits and units and is disposed at the other side of the cell 10, i.e. at the side of the base of the housing 8.

As emerges from FIG. 3, the movement 6 equipped with an antenna coil and its electronic communication unit form a compact device with a coil disposed directly on the periphery of the display surface of the LCD cell.

Finally, it will be mentioned that it is possible to provide a spacer 52 on the periphery of the cell 10 between the board 4 and the coil 20. Obviously, this spacer has the necessary recesses for the support 24 and the blades 34 and 35.

What is claimed is:

1. The portable electronic device, in particular a timepiece, comprising an electronic movement which is formed by a printed circuit board electrically connecting at least one electronic circuit, a digital display cell and a communication antenna formed by a coil having at least one turn, this coil having two ends, wherein said display cell extends above said board and said coil is disposed at the side of the upper surface of this display cell, the two ends of said coil being electrically connected to said board by two connection means defining two male connectors and two corresponding female connectors, and wherein the two male connectors are formed respectively by two elastically deformable blades.

2. An electronic device according to claim 1, wherein the two blades each have an ellipsoidal form.

3. An electronic device according to claim 1, wherein the two connection means are mounted on a support which has two electrical contact regions connected respectively to these two means, the two ends of said coil being electrically connected to these two regions, and wherein said two female connectors are formed by two metallised holes which are provided in said board.

4. An electronic device according to claim 3, wherein said support is mounted rigidly under said coil, the two connection means extending to the periphery of said display cell perpendicularly to said upper surface of said display cell.

5. An electronic device according to claim 1, wherein the two connection means are mounted on a support which has two electrical contact regions connected respectively to these two means, the two ends of said coil being electrically connected to these two regions, and wherein said two female connectors are formed by two metallised holes which are provided in said board.

6. An electronic device according to claim 5, wherein said support is mounted rigidly under said coil, the two connection means extending to the periphery of said display cell perpendicularly to said upper surface of said display cell.

* * * * *